US008790189B2

(12) United States Patent
Krause et al.

(10) Patent No.: US 8,790,189 B2
(45) Date of Patent: Jul. 29, 2014

(54) GOLF TEMPLATE AND METHOD

(75) Inventors: Robert Krause, White Lake, MI (US); Joanne Manley, Orchard Lake, MI (US)

(73) Assignee: BK Golf, LLC, Orchard Lake, MI (US)

( * ) Notice: Subject to any disclaimer, the term of this patent is extended or adjusted under 35 U.S.C. 154(b) by 164 days.

(21) Appl. No.: 13/429,770

(22) Filed: Mar. 26, 2012

(65) Prior Publication Data

US 2013/0252752 A1 Sep. 26, 2013

(51) Int. Cl.
*A63B 69/36* (2006.01)

(52) U.S. Cl.
USPC ..... 473/257; 473/218; 473/409

(58) Field of Classification Search
USPC ..... 473/218, 257, 266, 268, 269, 270, 272, 473/273, 278, 279, 409
See application file for complete search history.

(56) References Cited

U.S. PATENT DOCUMENTS

| | | | | | |
|---|---|---|---|---|---|
| 3,542,369 | A * | 11/1970 | Anderson | ..... | 473/257 |
| 4,915,387 | A * | 4/1990 | Baxstrom | ..... | 473/218 |
| 5,108,106 | A * | 4/1992 | Cook | ..... | 473/272 |
| 5,139,263 | A * | 8/1992 | Feo | ..... | 473/218 |
| 5,893,805 | A * | 4/1999 | Douglass | ..... | 473/218 |
| 5,954,592 | A * | 9/1999 | Laffer et al. | ..... | 473/220 |
| 6,945,875 | B2 * | 9/2005 | Gauer | ..... | 473/270 |
| 2003/0190972 | A1 * | 10/2003 | Townsend, II | ..... | 473/278 |
| 2007/0173339 | A1 * | 7/2007 | Rivard | ..... | 473/266 |
| 2009/0176595 | A1 * | 7/2009 | Hubley | ..... | 473/238 |
| 2009/0215548 | A1 * | 8/2009 | Broering | ..... | 473/220 |

* cited by examiner

*Primary Examiner* — Nini Legesse
(74) *Attorney, Agent, or Firm* — Carlson, Gaskey & Olds, P.C.

(57) ABSTRACT

A template for teaching a golfer a proper swing includes a false target disposed on a first portion of the template for positioning a golfer at a start of teaching a proper swing. A real target for being struck by the golfer during teaching is not disposed on the first portion of the template. A first marking is disposed on the first portion of the template, the first marking being disposed behind the false target and indicating a position for placing the real target off of the first portion of the template.

24 Claims, 3 Drawing Sheets

GOLF TEMPLATE AND METHOD

BACKGROUND

Golf is a game invented centuries ago that provides recreation to millions around the world and enables some to make a living as touring or teaching professionals. Though the concepts of the game are relatively simple requiring a user to choose a club and strike a ball with that club a desired direction and distance until the ball ends up in a cup—the mechanics of the game can be remarkably elusive for the amateur. Even with practice, proper instruction may be necessary for an amateur to improve.

One of the great plagues the game of golf inflicts on the amateur is slicing the ball. Slicing occurs if the golfer drags the face of the club across the ball at impact (e.g., hitting "outside in" or "over the top") thereby putting a side spin on the ball that aeronautically forces the ball to bend in flight to the right for a right-hand golfer or to the left for a left hand golfer. For the golfer who prefers the ball to fly straight (i.e., out of trouble) towards the cup, the slice can be very frustrating. Though the golfer may be afflicted with other plagues like hooking, duffing, yips, hitting thin or fat and the like, teaching professionals spend much of their time trying to teach the amateur the techniques needed to control the slice.

SUMMARY

According to an embodiment disclosed herein, a template for teaching a golfer a proper swing includes a false target disposed on a first portion of the template for positioning a golfer at a start of teaching a proper swing. A real target for being struck by the golfer during teaching is not disposed on the first portion of the template. A first marking is disposed on the first portion of the template, the first marking being disposed behind the false target and indicating a position for placing the real target off of the first portion of the template.

According to a further embodiment of the invention, a method of training a golfer to swing properly includes the steps of addressing a false target with a golf club, and eyeing a real target disposed between the golfer and the false target and behind the false target towards the golfer's back foot.

The various features and advantages of the disclosed examples will become apparent to those skilled in the art from the following detailed description. The drawings that accompany the detailed description can be briefly described as follows.

DETAILED DESCRIPTION

Figure 1:
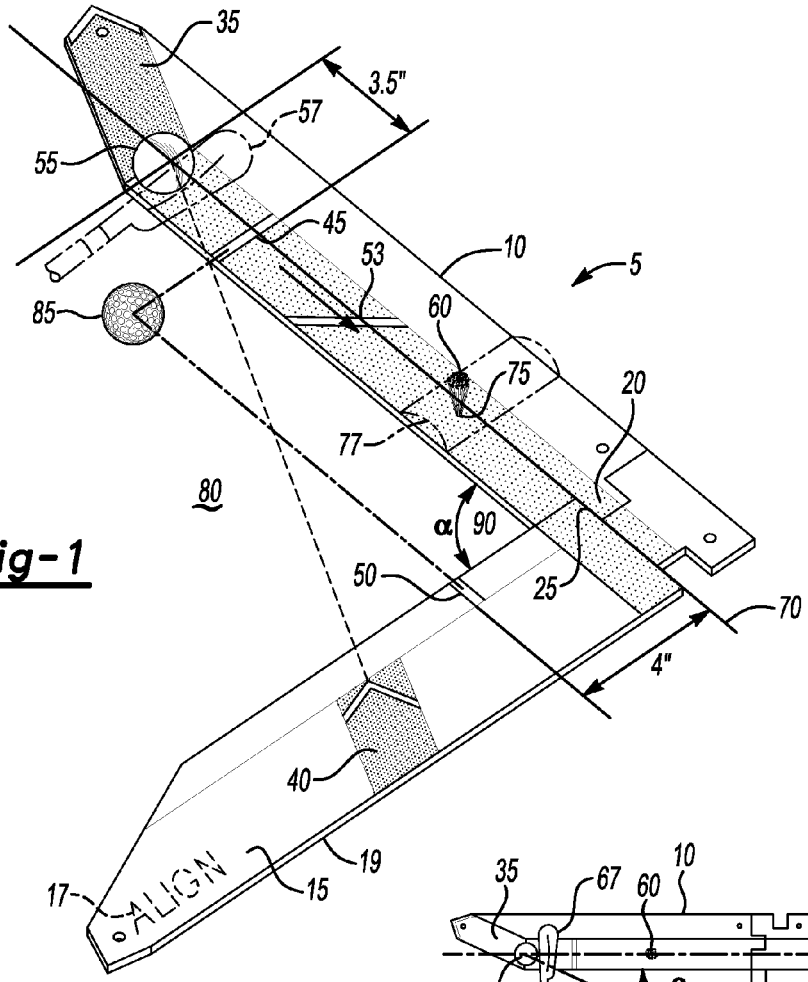
FIG. 1 shows a top view of a template for use in training a golfer to minimize a slice.
Figure 2:
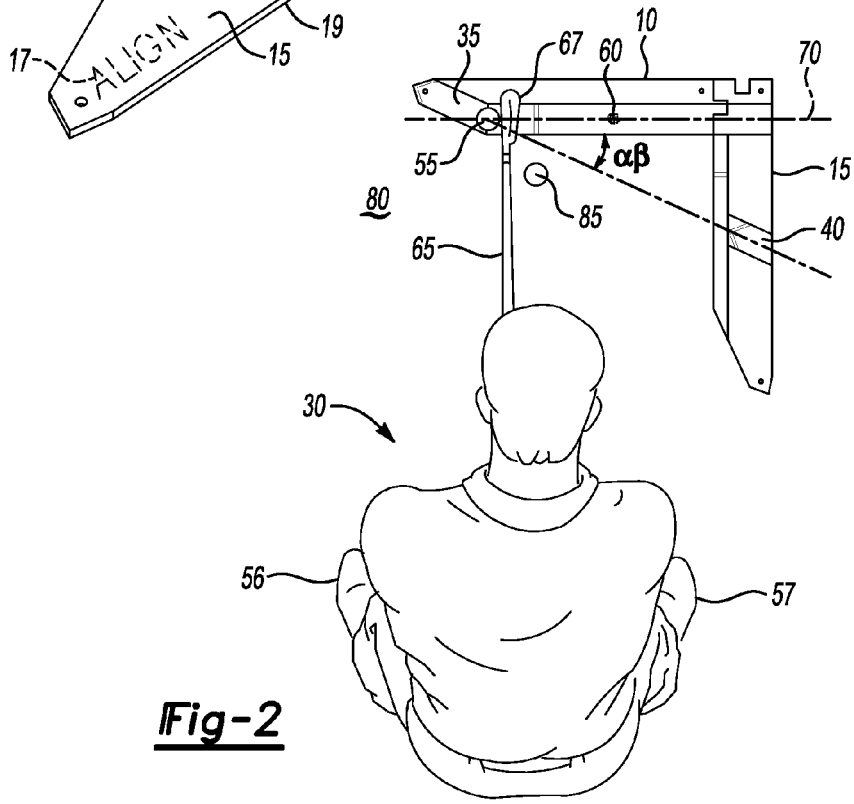
FIG. 2 shows a top view of a golfer addressing a false target on the template of FIG. 1.
Figure 3:
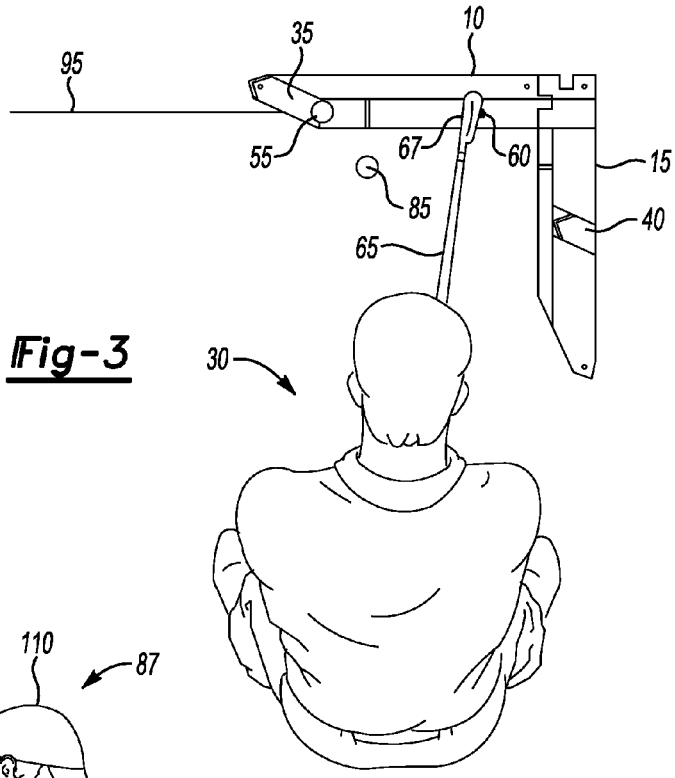
FIG. 3 shows a front side stick view of a golfer hitting a lift indicator on the template of FIG. 1.

Referring now to FIG. 1, a template 5 has a first portion 10 removably attaching to a second portion 15. The first and second portions 10, 15 are aligned at an angle $\alpha$ of about 90 degrees though other angles may be contemplated. The first portion 10 may have an extension 20 that fits within a depression 25 in the second portion so that the first portion 10 and the second portion 20 are separable for ease of transport. The first portion 10 and the second portion 15 are made of a flat material such as plastic, heavy cardboard or the like.

Each of the first portion 10 and the second portion 15 has indicia disposed thereon. The first portion 10 shows a first swing path 35 for a golfer's eye (not shown) to follow and the second portion 15 has a second swing path 40 for the golfer's eye to follow. The first swing path 35 and the second swing path 40 are aligned so that a single swing path is defined. The first portion 10 has a first target ball indicator 45 and the second portion 15 has a second target ball indicator 50. The first target ball indicator (or marking) 45 is about 2-5 inches, or 3.5 inches, behind a false target 55 (near the middle of the stance between the golfer's left foot 56 and the right foot 57), and the target ball indicator 50 is about 4 inches from the plane 70 passing along the first portion 10 through the false target 55 towards the golfer's back foot 57. The first swing path 35 and the second swing path 40 are aligned at an angle $\beta$ of about 20-34 degrees though 26 degrees may be chosen relative to the first portion 10. One of ordinary skill in the art will recognize that the first portion 10 and the second portion 15 may be detached, reversed and reassembled to show other indicia thereon for other training. See indicia 17 which is intended to be placed on a bottom 19 of second portion 15 (and may be any other golf training indicia).

In an alternative embodiment, another second target ball indicator 53 may be placed on the first portion 10 at an angle relative to the first target ball indicator 45. The target ball 85 may be placed properly by triangulating an intersection of the first target ball indicator 45 and the second target ball indicator 53. By placing the second target ball indicator 53 on the first portion 10, the template 5 may be used without the second portion 15.

The first portion 10 has false target 55 disposed thereon. The false target 55 may be two-dimensional, like the picture of a ball, or may be three-dimensional like a partial portion of a ball. A full-sized ball false target 55 is not desirable if it interferes with a swing as will be discussed infra. A club set-up indicia 57 is placed behind the false target 55.

A lift indicator 60 is located a distance of between 8-14 inches behind the false target 55 on the first portion 10 and 12 inches may be typically used. The lift indicator 60 provides either a visual or audible cue to the golfer 30 that it is time to start turning a club 65, having face 67, in plane 70 during the golfer's backswing. The lift indicator 60 may be a half tee, a brush tee or the like to give an audible click or other sound to the golfer to teach them it is time to turn. The lift indicator is about ¾ of an inch high. If the lift indicator 60 is missed by the golfer 30, the swing angle may be too steep causing the golfer 30, generally, to hit the ball thin or the golfer's arms might release too early or a golfer might scoop a ball in the follow through. If too much of the lift indicator 60 is struck, the swing angle may be too low causing, generally, the golfer 30 to hit the ball fat. The lift indicator 60 is replaceably disposed in a hole 75 in the first portion 10 so that if too much of the lift indicator 60 is struck on the back swing, the lift indicator 60 may pop out of the hole 75 without damaging the first portion 10. The lift indicator 60 may be repositioned in the hole 75. One of ordinary skill in the art will recognize that other indicators such as a proximity sensor, sonar or a switch that triggers a sound or light other indicia to indicate contact of the lift indicator may be used. The first swing path 35 is disposed outboard of the false target 55. The lift indicator may also be an upward extension or ripple 77 in the first portion 10.

Referring to FIGS. 1-4, the golfer 30 sets up with the club face 67 adjacent to the set up false target 55. The golfer 30 starts a backswing and once the golfer 30 has passed the lift indicator 60, the golfer starts to turn until the golfer completes a backswing (first position 87 in FIG. 4) where the club is parallel to the ground 80 upon which the template 10 lies. The golfer 30 then starts to swing towards a target ball 85 that is placed at an intersecting point between the first target ball indicator 45 and the second target ball indicator 50 on the second portion 15 (or second target ball indicator 53 on the first portion 10) between the golfer 30 and the first portion 10.

Once the golfer 30 has started to pull the club 65 away from the false target 55, the golfer is trained to look at the target ball 85 (e.g., a real target—see FIG. 4) in view of the first swing path 35 and the second swing path 40. Because of the focus on the target ball 85 in view of the first swing path 35 and the second swing path 40, as the golfer starts to swing downwardly from the first position 87, the golfer is forced to drop her hands downwardly in the slot 90 to hit the target ball 85. Typically, with professional players, the drop downwardly to a second position 89 (see FIG. 5) may be about a foot so the club face 67 may be directed through the target ball 85 without imparting a slice spin on it.

Figure 4:
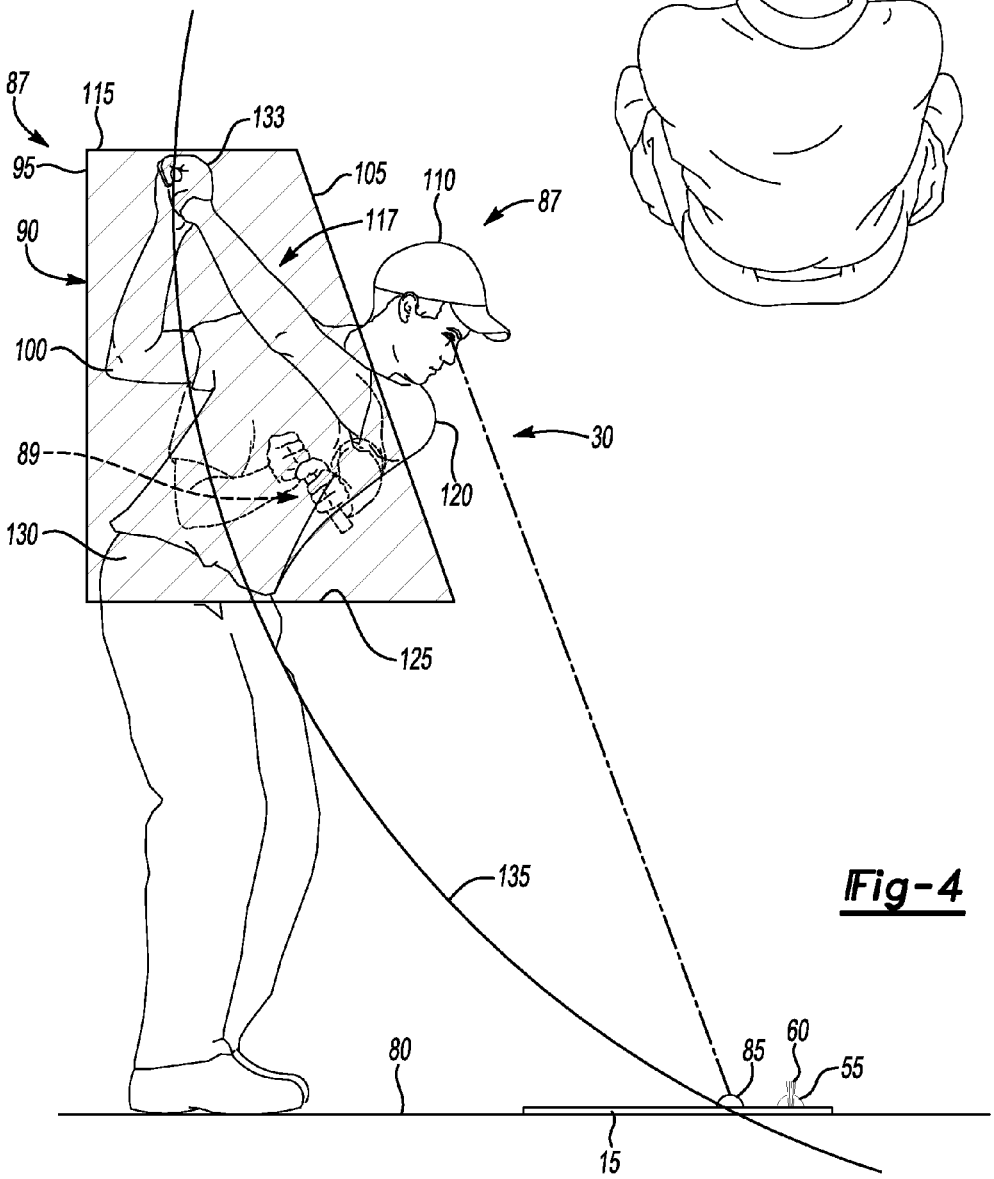
FIG. 4 shows a side view of a golfer with a completed backswing.
Figure 5:
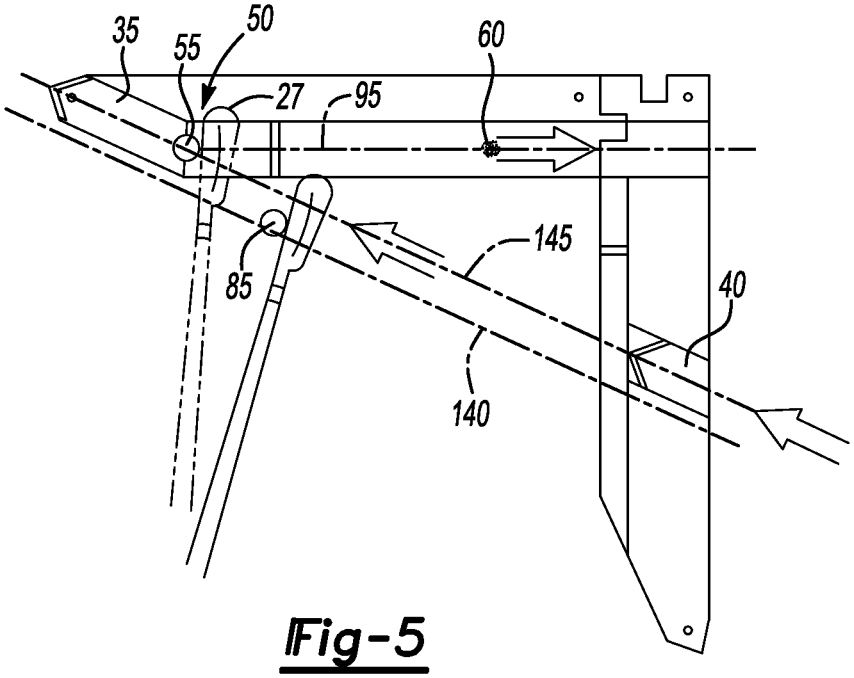
FIG. 5 shows a top view of a golfer following a swing path to strike a target ball both on the template of FIG. 1.

Referring to FIGS. 4 and 5, the slot 90 is an area seen best from behind the golfer 30 that includes an area defined by a first line 95 behind the golfer's right elbow 100 at the top of the back swing (first position 87) and a second line 105 from behind the golfer's head 110 towards the target ball 85, that are hemmed in by a third line 115 roughly parallel to the golfer's right and left shoulders 117, 120 at the top of the slot 90 and a fourth line 125 though the golfer's hips 130 at the bottom of the slot.

Dropping the hands 133 in the slot 90 to the second position 89 is an awkward motion that has two effects, muscle memory becomes enhanced because the motion is not easy for the golfer 30 who slices and the golfer is forced to follow the first swing path 35 and the second swing path 40 that is inside-out relative to the swing plane 135 of the club 65 which makes a slice highly unlikely.

An awkward motion may be easier for a golfer to remember because the motion may be very different from a swing that produces a slice. One of ordinary skill in the art will recognize from the teaching herein that the method and apparatus shown herein will improve those golfers who tend to hook the ball (e.g. who add opposite side spin to slice) as well by teaching them to determine a proper path for the club to follow during the swing by utilizing the first swing path indicia 35, the second swing path indicia 40, the placement of the target ball 85 and the lift indicator 60.

If the technique using the template is correctly done, the target ball 85 is struck solidly forward and to the right for a right-handed golfer or solidly forward and to the left for a left-handed golfer. Because the target ball 85 is struck solidly forward and to the right for a right-handed golfer, the false target 55 is not a full sized ball to avoid collisions therebetween. The face 67 of the club 65 is not closed, e.g. not perpendicular to plane 70 passing from the target ball 85 to an intended landing place (not shown) of the target ball along target line 95. The unclosed club face forces the ball off the target line 95. If the club face 67 closes towards perpendicular too early (typical of ones who hook the ball), the golfer 30 may learn that fact by hitting the second portion 15.

Referring to FIG. 5, a swing path 145 is taken after training is complete, the golfer 30 takes away the template and will find herself hitting along the swing path defined by the first swing path indicia 35 and the second swing path indicia 40. The club face will square itself to a ball (not shown but indicated in position by 55) to complete a proper swing and straight flight. The swing path 140 defined by the first swing path indicia 35 and the second swing path indicia 40 is in register with the swing path 145.

The golfer 30 practices hitting target balls 85 using the template for a given time between 5 and 30 minutes to groove the swing and then uses the lessons learned by striking a target ball 85 that is placed where the false target 55 is placed on the first portion 10 of the template 5 after the template 10 is removed. During training, the golfer 30 will strike the target ball 85 along the swing path 140 that is parallel but inside the swing path defined by the first swing path indicia 35 and the second swing path indicia 40.

The preceding description is illustrative and not limiting. A worker of ordinary skill in the art would recognize that certain modifications to the disclosed examples are possible and that features described in one example are not necessarily limited to that example and could be used in another example. For instance, one of ordinary skill in the art will recognize that the first portion 10 and the second portion 15 may be detached and reassembled to show other indicia thereon for other training. For that reason, the following claims should be studied to determine the scope of legal protection provided.

We claim:

1. A template for teaching a golfer a proper swing, said template comprising:

a false target disposed on a first portion for positioning a golfer at a start of teaching, a real target not disposed on said first portion, said real target for being struck by said golfer, a first marking on said first portion, said first marking being disposed behind said false target and indicating a position for placing said real target off of said first portion;

a backswing path extending along said first portion; and a first target swing path disposed on said first portion, said first target swing path extending transversely to said backswing path.

2. The template of claim 1 wherein a golfer addresses said false target and strikes said real target.

3. The template of claim 1 wherein said first target swing path minimizes a probability of creating a slice for a one-side dominant swing if a golfing swing passes in register with said first target swing path to strike said real target.

4. The template of claim 1 wherein said first target swing path is at an angle of about 22-34 degrees relative to a length of the first portion.

5. The template of claim 4 wherein said first target swing path is at an angle of about 26.5 degrees.

6. The template of claim 1 further comprising:

a second portion attached to said first portion and including a second target swing path in register with said first target swing path disposed on said second portion.

7. The template of claim 6 further comprising:

a second marking disposed on said second portion, said second marking indicating a position for placing said real target, wherein said first marking and said second marking cooperate to properly place the real target off the first portion and the second portion.

8. The template of claim 1 wherein a second marking is placed on said first portion for placing said real target in cooperation with said first marking.

9. The template of claim 1 wherein said real target is placed between about 2-5 inches behind said false target and about 3-6 inches from said first portion.

10. The template of claim 9 wherein said real target is placed between about 3.5 inches behind said false target and the real target is about 4 inches from said false target.

11. The template of claim 1 further comprising a turn indicator disposed on said first portion.

12. The template of claim 1 further comprising golf training indicia disposed on a second side of said template.

13. Method of training a golfer to swing properly comprising the steps of:

eyeing a false target, swinging a golf club through a backswing path on a first portion of a template; and swinging said golf club through a forward swing path in register with a first target swing path disposed on said first portion of said template, said first target swing path being transverse to said backswing path.

14. The method of claim 13 further comprising:

dropping said golf club through a slot from a first position to a second position while swinging towards a real target.

15. The method of claim 14 further comprising:

striking said real target.

16. The method of claim 14 wherein said golf club is generally parallel to the ground in the first position.

17. The method as recited in claim 16 wherein said first target swing path intersects said backswing path at said false target.

18. The method of claim 13 wherein said forward swing path is parallel to said first target swing path.

19. The method of claim 13 further comprising:

removing said false target and striking a ball that is in the position of the false target.

20. The method of claim 13 further comprising:

attempting to hit a lift indicator while swinging said golf club through said backswing path.

21. The method of claim 13 further comprising:

eyeing said first target swing path while swinging said golf club through said forward swing path.

22. The method of claim 13 further comprising:

placing a real target between about 2-5 inches behind said false target and about 5-7inches from said false target towards said golfer.

23. The method of claim 13 further comprising:

eyeing a real target disposed between the golfer and the false target and behind the false target towards said golfer's back foot.

24. A template for teaching a golfer a proper swing, said template comprising:

a false target disposed on a first portion of said template;

a first target ball indicator and a second target ball indicator configured to indicate a location of a real target; and a first marking indicating a first target swing path, the first target swing path does not extend through the real target.

* * * * *